US006278368B1

(12) United States Patent
Goldberg et al.

(10) Patent No.: US 6,278,368 B1
(45) Date of Patent: Aug. 21, 2001

(54) LOW COST MATERIAL FOR MULTI-BIT REMOTE SENSING

(75) Inventors: Ira B. Goldberg, Thousand Oaks; Ted M. McKinney, Riverside; Charles S. Hollingsworth, Thousand Oaks, all of CA (US); Jonathan R. Engdahl, Chardon, OH (US); Elik I. Fooks, Lexington, MA (US)

(73) Assignee: Rockwell Technologies, LLC, Thousand Oaks, CA (US)

( * ) Notice: Subject to any disclaimer, the term of this patent is extended or adjusted under 35 U.S.C. 154(b) by 0 days.

(21) Appl. No.: 09/409,331

(22) Filed: Sep. 30, 1999

Related U.S. Application Data

(63) Continuation-in-part of application No. 09/290,454, filed on Apr. 12, 1999.

(51) Int. Cl.[7] ..... G08B 13/14

(52) U.S. Cl. ..... 340/572.4; 340/551; 340/572.6

(58) Field of Search ..... 340/551, 572.1, 340/572.4, 572.5, 572.6, 572.7, 568.1; 235/449, 450, 491, 493; 75/347, 348, 362

(56) References Cited

U.S. PATENT DOCUMENTS

| | | | | |
|---|---|---|---|---|
| 4,215,342 | * | 7/1980 | Horowitz | 340/572.4 |
| 4,915,728 | * | 4/1990 | Schell | 75/347 |
| 5,576,693 | * | 11/1996 | Tyren et al. | 340/572.4 |
| 5,664,582 | * | 9/1997 | Szymaitis | 128/898 |
| 5,834,748 | * | 11/1998 | Litman | 235/450 |
| 5,988,500 | * | 11/1999 | Litman | 235/450 |
| 6,053,406 | * | 4/2000 | Litman | 235/449 |

* cited by examiner

*Primary Examiner*—Van T. Trieu
(74) *Attorney, Agent, or Firm*—Keith M. Baxter; John J. Horn; William R. Walbrun

(57) ABSTRACT

Multiple bits of information may be conveyed by passive target material incorporating filaments of magnetizable material having different magnetization functions and, in particular, different coercivities. Detection of the presence or absence of the individual filaments may be done remotely by measuring induced flux B as a function of an externally imposed magnetic field waveform and subjecting the measured induced flux signal to differentiation or Fourier transform techniques.

20 Claims, 5 Drawing Sheets

FIG. 1
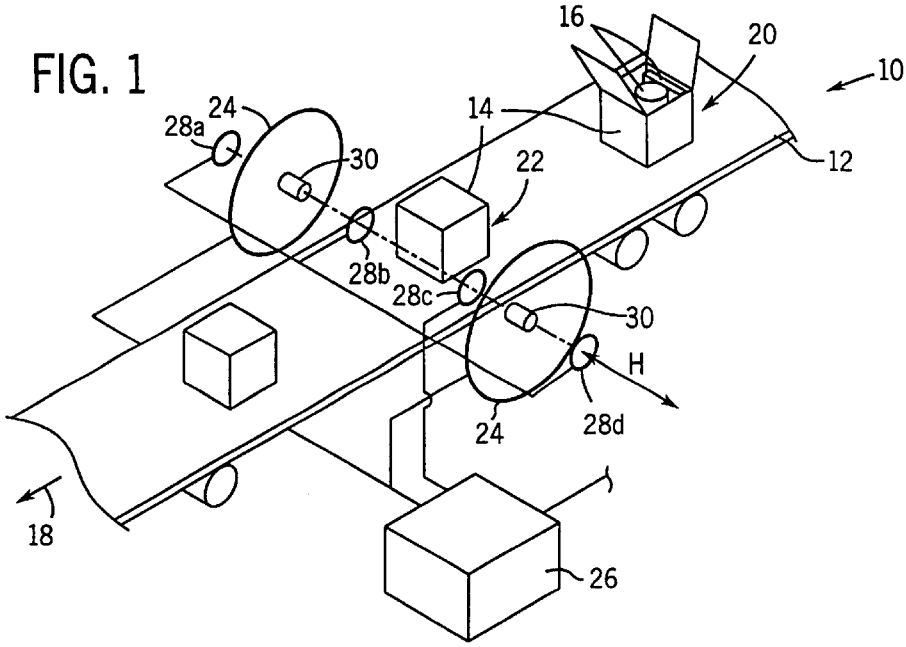
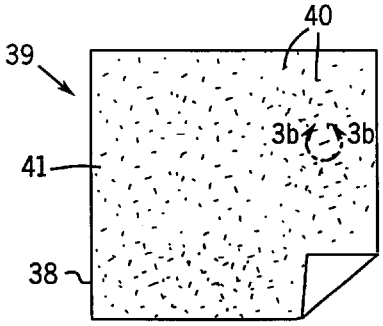
FIG. 3a
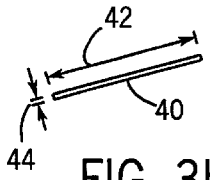
FIG. 3b
FIG. 2
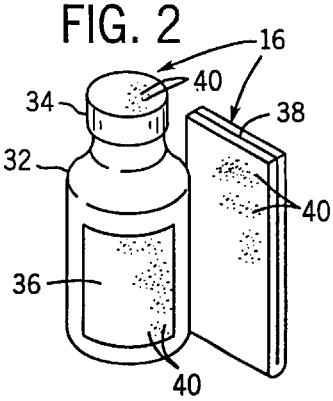
FIG. 4
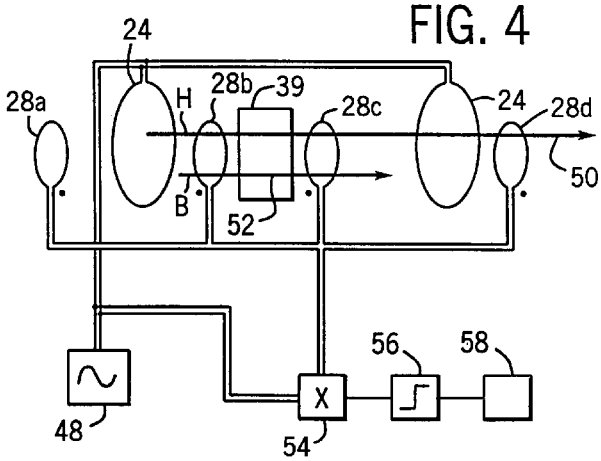

LOW COST MATERIAL FOR MULTI-BIT REMOTE SENSING

CROSS-REFERENCE TO RELATED APPLICATIONS

This application is a continuation-in-part of U.S. application Ser. No. 09/290,454 filed Apr. 12, 1999.

BACKGROUND OF THE INVENTION

The present invention relates to systems and materials for presence sensing, and in particular, to a low cost material with magnetizable filaments whose presence may be sensed remotely by an industrial control system to communicate multiple bits of information.

In the manufacture of a multi-component product, for example, packaged pharmaceuticals intended for over-the-counter sale, it is important to verify that the package includes a paper insert listing the characteristics of the drug and instructions for safe use. While considerable care is taken in placing the insert into the package, ideally, its presence in the package could be verified after the package is sealed. One way of doing this is by weighing the package to detect the additional weight of the insert. For light inserts or products that vary in weight, such an approach is unreliable.

The parent to the present application describes a method of verifying the presence of a component of a manufactured product by incorporating a small percentage of filamentized magnetic material into that component whose presence may be detectable at a distance. The filaments are of low cost and may be freely dispersed into the material of the component for manufacturing convenience and may be remotely sensed even through packaging or the like.

While the ability to sense an individual component in a manufactured product is valuable, often it may be necessary to sense combinations of components or to distinguish between different component types. It would be desirable to have a method of communicating not simply presence or absence of a component representing a single binary "bit" of information, but to be able to detect combinations of components and to distinguish between different components such as requires the communication of multiple bits of information.

BRIEF SUMMARY OF THE INVENTION

The present inventors have recognized that low cost magnetizable filaments similar to those described above may be used to convey, not merely a "presence" or "absence" signal, but multiple bits of information. In particular by using magnetic materials having different coercivities, distortions in an externally imposed periodic magnetic waveform will be displaced in phase for the different magnetic materials allowing independent detection of each material. The presence or absence of each material provides one bit of information in a multi-bit word. The length of the multi-bit word is determined by how many different materials are used.

Specifically, the present invention provides a marker material suitable for remote sensing of multi-bit information including a non-magnetic matrix and at least a first and second set of magnetic filaments supported and dispersed by the matrix. Each set of magnetizable filaments has a first functional relationship between magnetic induction (B) and magnetic field (H) that differs from the others.

Thus, it is one object of the invention to provide an easily manufactured and low cost material for conveying multiple bits of information to a remote sensor. The filaments are relatively inexpensive and their orientation need not be precisely controlled, therefore they may be easily incorporated into a variety of materials.

The proportion of the filaments of the first and second filament sets may be a predetermined unequal proportion based to their detectability by a remote sensor.

Thus it is another object of the invention to provide flexibility in selecting the magnetic material allowing the use of materials with different coercivity and low permeability while ensuring adequate signal levels.

The present invention also provides for a sensing apparatus for the material containing the multiple sets of magnetizable filaments. Specifically, the sensor includes an electric oscillator producing a waveform having a fundamental frequency and an antenna structure connected to the electric oscillator for transmitting the waveform as an electromagnetic field to envelop the sets of magnetizable filaments. A receiver, connected to the antenna structure, receives the electromagnetic field as modified by the sets of magnetizable filaments and a detector discriminates between their magnetic properties to independently detect the individual sets of magnetizable filaments.

Thus, it is another object of the invention to provide a simple method of remotely detecting the multi-bit information.

The detector may be a differentiator (as is implicit in a coil detector) and a phase sensitive threshold detector detecting peaks in the derivative of the received electromagnetic field as a function of the phase of the waveform of the electric oscillator.

Thus, it is another object of the invention to exploit the effect of the magnetizable filaments in causing distortions of an applied magnetic field such as changes the instantaneous slope with respect to time of the electromagnetic field.

Alternatively or in addition, the remote sensing system may include a Fourier transformer and a threshold detector for detecting magnitudes of Fourier components at predetermined harmonics of the waveform of the electric oscillator.

Thus, it is another object of the invention to provide a method for more generally detecting distortion of the applied electromagnetic field.

The present invention may be used in verifying manufacturing operations in the assembly of multi-component products or the like. In this application, a first and second component of the multi-component product are identified and magnetizable filaments having different magnetic properties are attached respectively to the first and second components. The assembled multi-component product is then exposed to an electromagnetic waveform and the distortion of the waveform caused by different magnetic induction in the magnetizable filaments is detected to detect the presence of the first and second components. An output signal is provided indicating proper assembly of the multi-component product.

The output signal may indicate that none or both sets of magnetizable filaments for the first and second components have been detected or that a specific one and only one of the sets of magnetizable filaments have been detected.

Thus, it is another object of the invention to provide a method not only of ensuring proper assembly of multiple component devices requiring both a first and second component or in distinguishing between different versions of a multi-component product having, in the alternative, the first or second components. Numbers may be encoded in binary format according to the presence or absence of the detected sets.

The foregoing and other objects and advantages of the invention will appear from the following description. In the description, reference is made to the accompanying drawings which form a part hereof and in which there is shown by way of illustration a preferred embodiment of the invention. Such embodiment does not necessary represent the full scope of the invention, however, and reference must be made to the claims herein for interpreting the scope of the invention.

BRIEF DESCRIPTION OF THE SEVERAL VIEWS OF THE DRAWINGS

FIG. 1 is a perspective view of an assembly line in which a product including material of the present invention is enclosed in a package and later remotely sensed by a sensing device of the present invention;

FIG. 2 is a perspective view of example uses of material of the present invention including a package cap, label, and instructional insert;

FIG. 3A is a plan view showing the instructional insert of FIG. 2 having magnetic filaments dispersed within a paper matrix;

FIG. 3B is a plan view showing a magnetic filament of FIG. 3A in enlarged detail;

FIG. 4 is a schematic diagram of the sensing device of FIG. 1 employing synchronous detection of magnetization of the filaments;

DETAILED DESCRIPTION OF THE INVENTION

Figure 5:
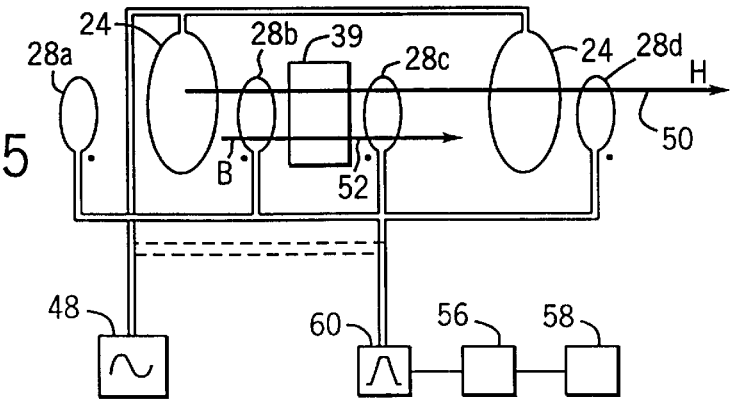
FIG. 5 is a figure similar to that of FIG. 4 showing an alternative embodiment of the sensing device employing frequency domain analysis of the total magnetization to detect saturation of the filaments of FIG. 3.

Referring now to FIG. 1, an assembly line 10 may include a conveyor belt 12 transporting boxes 14 along a direction 18. At a first station 20, the box 14 may be opened and a product 16 is installed therein. With further motion of the conveyor belt 12 in direction 18, the box 14 is brought to a second station (not shown) where the box is closed and sealed.

At a third station 22, the box and the product 16 contained therein pass between coils 24 coaxially opposed across the conveyor belt 12 perpendicular to the direction 18. As will be described below, the coils 24 are connected together as a Helmholtz coil pair for the generation and detection of electromagnetic signals in the volume between the coils 24. It will be understood that the coils 24 may be connected in series or in parallel to provide the Helmholtz configuration or may use separate properly phased amplifiers. Other well known types of sensing and excitation coils may be used. A pair of sensing coils 28 may also be positioned coaxial with the coils 24, but closer to the path of the box 14 on the conveyor belt 12. Alternatively as shown, four detection coils 28*a*–28*d* may be used to substantially reduce the detection of the fundamental signal from the coils 24. The pair 28*b* and 28*c* are arranged so that the induced voltages add. The second pair 28*a* or 28*d* are added so that one of the coils 28*a* is to the left of left coil 24 and the other coil 28*d* is to the right of right coil 24. They are further away from the magnetic filaments so that they do not detect them but substantially only the fundamental from coils 24. The signals from coils 28*a* and 28*d* subtract from the signals from coils 28*b* and 28*c* reducing the first harmonic substantially to zero allowing a higher dynamic image in the detection of the filament signals. Alternatively, as will be understood in the art, the sensing coils may be replaced or supplemented with a Hall effect device, a giant- or anomalous magneto resistance sensor, a flux-gate device or any other magnetometer. These detectors may also be combined with fundamental canceling detectors analogous to coils 28*a* and 28*d* described above.

Conventional proximity sensing elements 30 such as photoelectric sensors may also be positioned along the conveyor belt 12 to detect the presence of the box 14 in third station 22 so as to activate the sensing of the box's contents, as will be described below.

Referring now also to FIG. 2, the product 16 within the box 14 may include, for example, a bottle 32 containing a pharmaceutical material. The bottle may have a resealable cap 34, a label 36 affixed to the bottle's surface, and may be packaged with a paper insert 38 providing information about the pharmaceutical material.

At different stages of the product's manufacture, it may be desirable to determine the presence of any one or all of the cap 34, label 36 and paper insert 38. Accordingly, any one or all of the materials of these elements may be treated by the incorporation of a plurality of magnetic filaments 40 into the material of the element. In the case of a cap 34, the filaments may be mixed with the thermoplastic from which the cap is molded in the manner of fiberglass and other reinforcement materials according to techniques well known in the art in which the filaments are dispersed in the liquefied plastic.

For the label 36, which for the purpose of example, may be printed directly on the bottle 32, the filaments 40 may be mixed with the printing inks. It will be understood that alternatively, the filaments could be in the label paper or adhesive. The paper insert 38 may have filaments 40 that were introduced during the papermaking process to blend and disperse with the cellulose fibers of the paper pulp. The paper may then be processed and printed by conventional means. The filaments may also be encompassed into woven, knitted or nonwoven fabrics, cardboard, ceramic and composite wood products.

Referring now to FIG. 3, in the present example of FIG. 1, it may be desired to confirm that the paper insert 38 is within the box 14 after the box has been sealed. Accordingly, in this case, only the paper insert 38 includes the filaments 40. The filaments 40 are randomly dispersed within the paper constrained only by the thickness of the paper (causing the filaments to lie within the plane of the paper) and a degree of alignment caused by papermaking process which align the fibers of the paper in a "grain" generally determined by the water flow over the Fourdrinier screens. In the present example, however, within the plane of the paper, it is desired that the filaments 40 obtain the greatest random dispersion both in location and orientation to ensure a signal regardless of orientation of the paper insert 38 after it has been folded and placed in the box 14.

Each of the filaments 40 in the preferred embodiment is constructed of an easily magnetizable material or "soft" magnetic material of coercivity of less than 2400 amperes/meter (30 Oersted) and preferably less than 1200 amperes/meter (15 Oersted). Coercivity is the magnetic field that must be applied opposite to the magnetization direction of a magnetically saturated material that is required to reduce the magnetization to zero. Suitable materials include Permalloy, Nickel iron alloy, Supermalloy, and Feralloy, Magnetic Stainless Steel, low carbon steel, however, other similar materials may be used. The more easily the material is magnetized and the greater its saturation, the greater the signal that may be produced by the filaments 40 and the further away the filaments 40 may be detected as will be described. The material of the filaments 40 may preferably have a saturation induction from about 0.5 to 2 tesla (5000 to 20,000 gauss) to allow them to be more readily detected. A permeability of larger than 100 is preferred. A limit on the permeability or the number of filaments, however, may be established so that the filaments 40 do not trigger anti-shoplifting devices which may use a similar principle of detecting saturation of larger foils of magnetic materials within a magnetic field.

Desirably the filaments 40 have a very high aspect ratio, the aspect ratio being a ratio between the filament's length 42 and diameter 44 (shown much exaggerated in FIG. 3). In the preferred embodiment, a length of 3 mm and a diameter of 8 microns has been found to be achievable, however, generally aspect ratios of greater than 3 will realize some improvement in signal strength and aspect ratios of greater than 200 may be desired. The high aspect ratio decreases demagnetization effects in which the material of the filaments 40 fight the external magnetic field applied to the filaments 40. Thus generally higher aspect ratios are preferred.

The size of the filaments 40 in length and diameter may be adjusted so as to improve their miscibility with the matrix material 41 of paper, plastic or paint. Generally in these cases, it is desired that the filaments 40 remain suspended and not settle from the matrix during the processing. The optimum size of the filaments 40 may be determined empirically. The small size in diameter of the filaments 40 render them invisible or nearly invisible when incorporated into paper or other materials. Filaments 40 may be clad with a noncorrosive material so as to prevent rusting in place in the matrix.

The matrix material 41 may be selected from a variety of non-magnetic low permeability materials. Together the filaments 40 as dispersed in the matrix material 41 produce a target material 39 whose presence may be remotely sensed.

Referring to FIG. 4, detection of the target material 39 may be performed in a number of different manners. In a first system, the Helmholtz coils 24 are connected to electrical amplifier/oscillator 48 driving the coils with a sine wave signal preferably having a value between 500 Hz and 3000 kHz so as to make use of high powered audio frequency amplifier components. It will be understood that the exact frequency may be chosen for convenience. High frequencies increase the sensitivity of the pick-up coil and decrease the interference from 60 cycle harmonics from power lines and the like. The amplifier/oscillator 48, so connected, creates an oscillating external magnetic field 50 (H) aligned with the axis of the coils 24. The target material 39 when stimulated by the H-field 50 causes a magnetic induction field 52 (B), being the result of a magnetization M of the filaments 40 (and in particular those filaments aligned with the H-field 50).

The B-field 52 may be received by sensing coils 28 which measure the derivative with respect to time of the B-field 52 and detected by means of phase detector 54 whose output may be provided to a magnitude or threshold detector 56 to produce a signal at I/O block 58 such as may be connected to an industrial control system or the like to provide an output signal and effect a predetermined control action. The phase detector 54 detects the B-field 52 only so far as it is at the proper phase with the H-field 50 so as to reduce the effects of environmental noise on the detection process. It will be understood that the coils 28 may be another form of magnetization detection such as a Hall effect device or the like.

Referring now to FIG. 5, in an alternative embodiment of the detection system, the coils 24 are again attached to amplifier/oscillator 48 in parallel so as to generate an oscillating H-field 50 along their axis. The sensing coil 28 may be used to detect the B-field 52 from the target material 39 or alternatively the coils 24 may serve double duty both as transmitting and receiving antennas. In either case, a B-field signal may be provided to a band pass filter 60 having a pass band admitting only a frequency significantly above the fundamental frequency $f_o$ of the amplifier/oscillator 48. In this way, together or as an alternative to the signal subtraction described above, distortion of the waveform may be detected such as results in the introduction of higher ordered harmonics to a sine wave. It will be recognized that other waveform distortion detection systems may be used.

Figure 8:
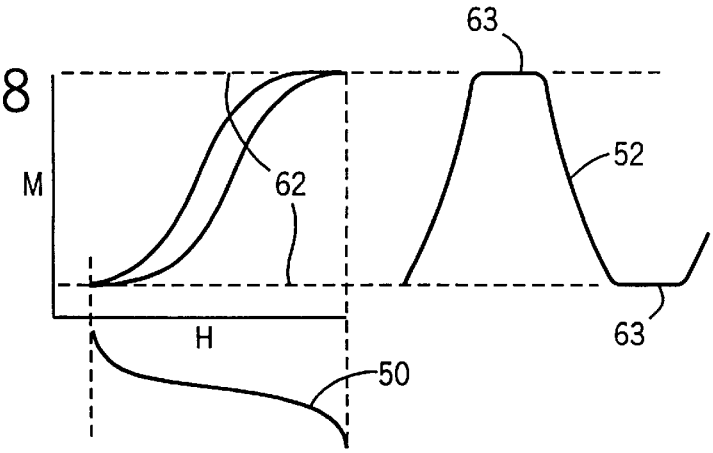
FIG. 8 is a plot of magnetic induction M vs. external magnetic field H showing saturation of the magnetic filaments of the material of the present invention.

Referring now to FIG. 8, the distortion of the B-field 52 with respect to the H-field waveform results from phenomenon of magnetic saturation of the filaments 40. The filaments 40 under the presence of the external field H 50 and as a function of their permeability and softness, will become magnetized in conformity with the H-field 50 producing a greater magnetization M with increasing field H up to saturation limits 62 whereafter no further increase in magnitude of the magnetization may be had because all magnetic domains are aligned. At this point the M field is truncated as indicated by plateaus 63 with the effect that the B-field 52 experiences a distortion introducing the higher ordered harmonics that are detected.

Figure 6:
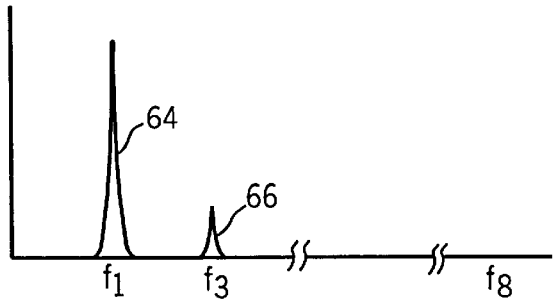
FIG. 6 is a spectrum diagram of the output of the sensing device of FIG. 5 in the absence of material of the present invention.

Referring to FIG. 6, if the H-field is essentially a pure sine wave, in the absence of any saturated material, the detected B-field 52 will exhibit a fundamental frequency 64 at the frequency of the sine wave and possibly a low order harmonic 66 resulting from imperfections in the sine wave generation but essentially no harmonic content above the third harmonic.

Figure 7:
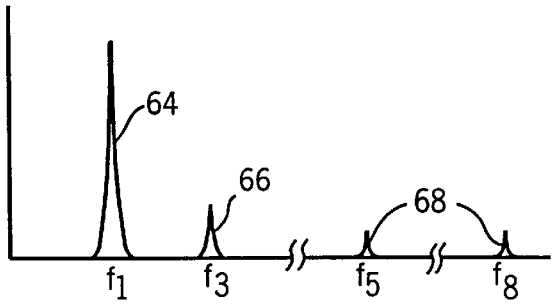
FIG. 7 is a figure similar to that of FIG. 6 showing output of the sensing device of FIG. 5 in the presence of material of the present invention.

Referring to FIG. 7, with the introduction of the target material 39 however and its saturation, harmonic components 68 will be introduced starting at the third harmonic and extending to the fortieth and beyond harmonic as shown in FIG. 7 in amount depending on the strength of the M component, the magnitude of the applied field 50, and the sharpness of the saturation plateaus 63. These harmonic components, isolated through the band pass filter 60 of FIG. 5 are provided to the threshold detector 56 to provide the output I/O block 58 to an industrial control system or other output device as has been described. The control system may provide an output indicating proper assembly of a multi-component product having a critical component incorporating the target material 39.

In an alternative embodiment not shown, the axis between the coils 24 may differ from the axis of the coil 28 so as to obtain off axis signal B-field 52. Techniques to reduce the detection of the external field H and to enhance the detection of the local field B may include a subtraction of the signal from the amplifier/oscillator 48 in phase with the detected signal or the use of sensing coils 28 wound in opposition so as to provide a cancellation effect for the H-field 50 positioned asymmetrically with respect to the target material 39 so as not to cancel the detected magnetization, or the coil-based subtraction technique described above, as is generally understood in the art.

Multi-Bit Detection

Referring again to FIGS. 2 and 3 it may be desirable to detect all three of the cap 34, label 36 and paper insert 38. Alternatively, it may be desirable to detect among alternative versions of the paper insert 38. For these purposes, several different sets of magnetic filaments 40 having different magnetic properties may be used.

Different ones of the sets of filament 40 may be incorporated into each of the cap 34, label 36 and paper insert 38 so as to individually detect the presence or absence of each of these components. The number of simultaneously detectable components will be equal to the number of different sets of filaments 40.

Alternatively, different ones or combinations of the set of filaments 40 may be incorporated into the label 38, the presence or absence of each such filament forming a single binary bit of a multi-bit word. The number of different variations in a single detected component will be equal to $2^N$ where N is the number of different types of filaments 40.

Figure 9:
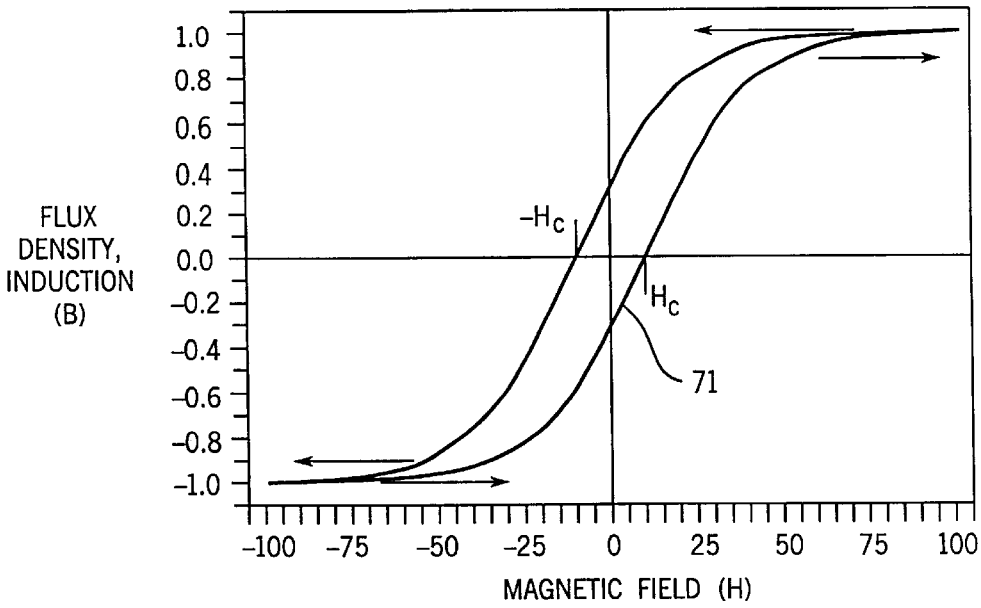
FIG. 9 is a plot similar to that of FIG. 8 showing the definition of magnetic coercivity.

Referring to FIG. 9, the different sets of filaments 40 suitable for this purpose have different magnetic properties as defined by the set material's magnetization curve 71. The magnetization curve 71 shows the functional relationship between an applied external magnetic field H and induced magnetic field B. As is understood in the art, the function relating B and H is dependent upon the direction of change of the H-field producing a hysteresis whose magnitude measured at B=0 is the material's coercivity $H_c$. Generally, in the preferred embodiment, the materials of each different set of filaments 40 will have different coercivities.

Figure 10:
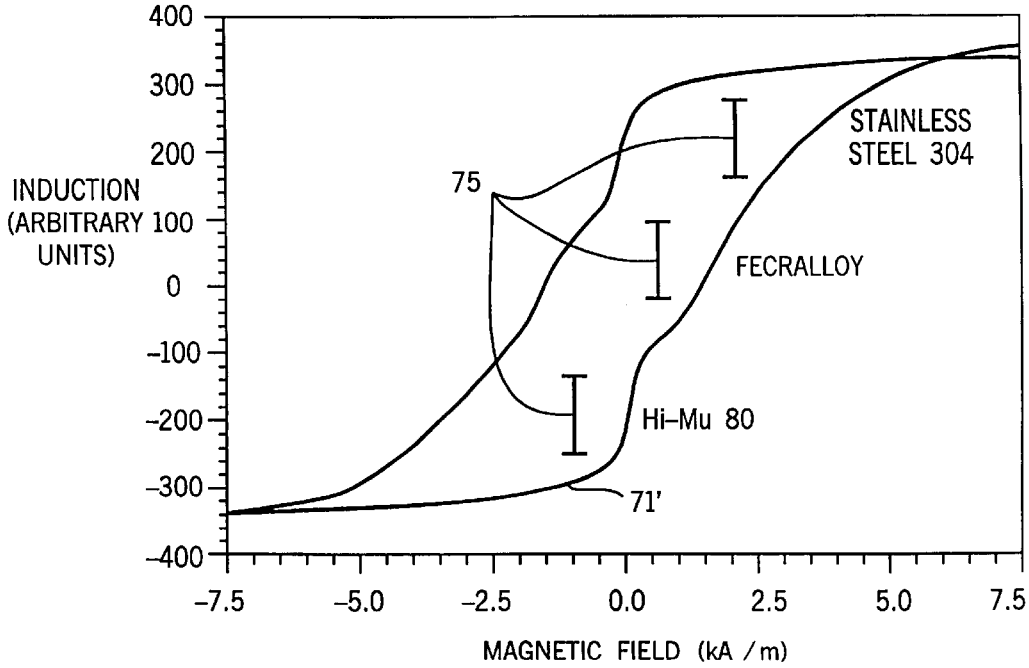
FIG. 10 is a plot similar to that of FIGS. 8 and 9 showing the effect on the hysteresis curve of the introduction of three different filaments providing three different magnetic coercivities per the present invention.

Referring now to FIG. 10, a magnetization curve 71' for a mixture of multiple sets of filament 40 is the superposition of the magnetization curves for each different material of the different sets of filaments 40. As will be noted from inspection of the magnetization curve 71' , each material provides an identifying region 75 of increased slope.

Figure 11:
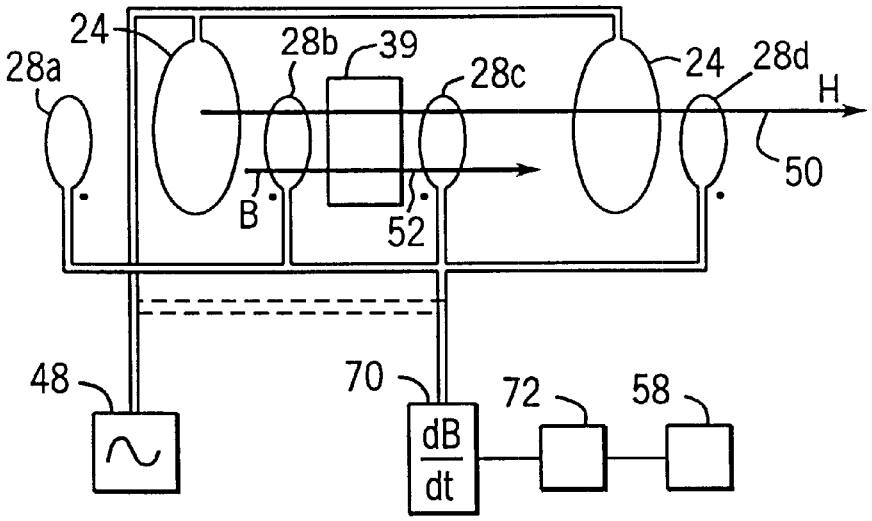
FIG. 11 is a figure similar to that of FIG. 4 showing a sensing device for detecting multiple different filaments having different coercivities and using a differentiating circuit.
Figure 12:
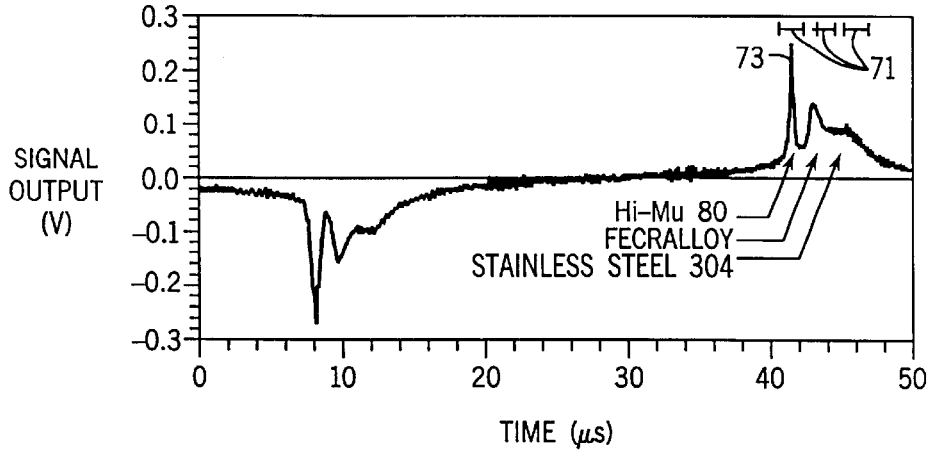
FIG. 12 is a plot of signal output from the differentiation of FIG. 11 versus time measuring a derivative of the induction units of the graph of FIG. 10 and showing multiple peaks caused by each of the magnetic filaments of the three sets.

Referring now to FIG. 11, these regions 75, and hence the materials causing them, may be detected by differentiating the signal from the B-field 52 as occurs naturally from sensing coil 28 and as is indicated by differentiator block 70 to provide a derivative signal 73 shown in FIG. 12. The derivative signal 73 plotted as a function of time or of phase of the H-field 50 exhibits peaks 77 corresponding to regions 75. The presence of each of the different sets of filament 40 may be thus detected by a phase sensitive threshold detector 72 measuring the derivative signal 73 at predetermined times that correspond to the different phases in the cycle of the H-field 50 corresponding to the times of occurrences of the peaks 77 and comparing the derivative signal 73 at those times to predetermined empirically derived thresholds. The sets of filaments 40 providing less distinctive peaks 77 may have their relative proportions with respect to other sets of filaments 40 increased.

Figure 13:
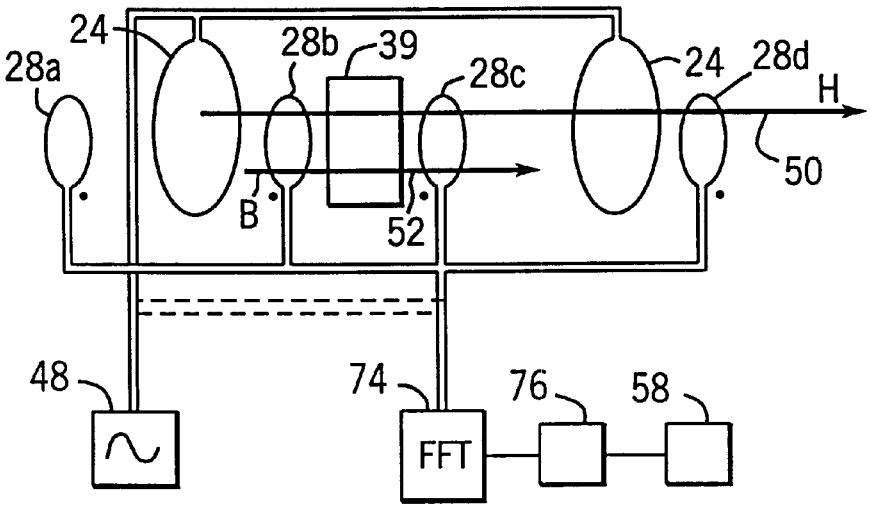
FIG. 13 is a figure similar to that of FIG. 10 showing a sensing device for detecting multiple different filaments having different coercivities and using a Fourier transform circuit.

Referring now to FIG. 13, an alternative detector obtains the signal of the B-field 52 from sensing coil 28 and takes the Fourier transform of that signal or its derivative through Fourier transform circuit 74 to produce the Fourier transform signal 78 shown in FIG. 12. The Fourier transform circuit 74 may be realized using a digital signal processor (DSP) or the like. The Fourier transform signal may be obtained with an H-field 52 having a frequency of one kilohertz although other frequencies are possible, too.

The asymmetry in the B-field 52 induced by hysteresis causes odd harmonics in the Fourier transform to be of particular value in distinguishing the presence or absence of particular sets of filaments 40. The Fourier transform signal 78 is provided to a frequency dependent threshold detector 76 which may detect the values of Fourier coefficients of the Fourier transform signal 78 or preferably compare Fourier coefficients against each other to detect individual or combinations of sets of filaments 40 according to empirically derived values. Combinations of different sets of filaments produce destructive reinforcement which is most easily detected with the Fourier transform. Another advantage of the Fourier transform is that the range of the H-field can be kept constant and different harmonics selected to determine the presence or absence of different components.

EXAMPLE 1

Samples of different sets of filaments 40 were prepared as mixtures of approximately 10–20 milligrams of each of one, two and three magnetic materials comprising Hi-Mu 80 (also known as Supermalloy), Iron-Chromium-Yttrium (Feralloy) and stressed Stainless Steel 304. To precisely control the coercive field produced by the filaments 40, specific treatments were provided. The Hi-Mu 80 filaments were annealed at 650° Centigrade to obtain smaller hysteresis and to maximize sensitivity. It is noted that heating in the range of 675° to 800° Centigrade results in a smaller increase in permeability than annealing between 625° and 675° Centigrade while heating at temperatures above 800° Centigrade can result in sintering of the filaments. After annealing, the Hi-Mu 80 filaments can be cut without significant decrease in the permeability, suggesting that for production, annealing can be done at the end of the filament drawing process prior to cutting the filaments.

The Fecralloy filaments were used as stressed materials in an unannealed state. It is believed that two or more different distinct magnetic functions may be obtained with Fecralloy depending on the type of annealing process so that the Fecralloy filaments may produce two different functional relationships that may be distinguished.

As shown in FIG. 10, the Hi-Mu 80 filaments 40 had lowest coercivity providing for a quick upward rise in the magnetization curve 71' with increasing H-field 50 followed by the effect of the Fecralloy alloy and then by the Stainless Steel 304 filaments. Thus in FIG. 12 the first peak is produced by the Hi-Mu 80 filaments, second by the Fecralloy filaments and the third by the Stainless Steel 304 filaments.

Figure 14:
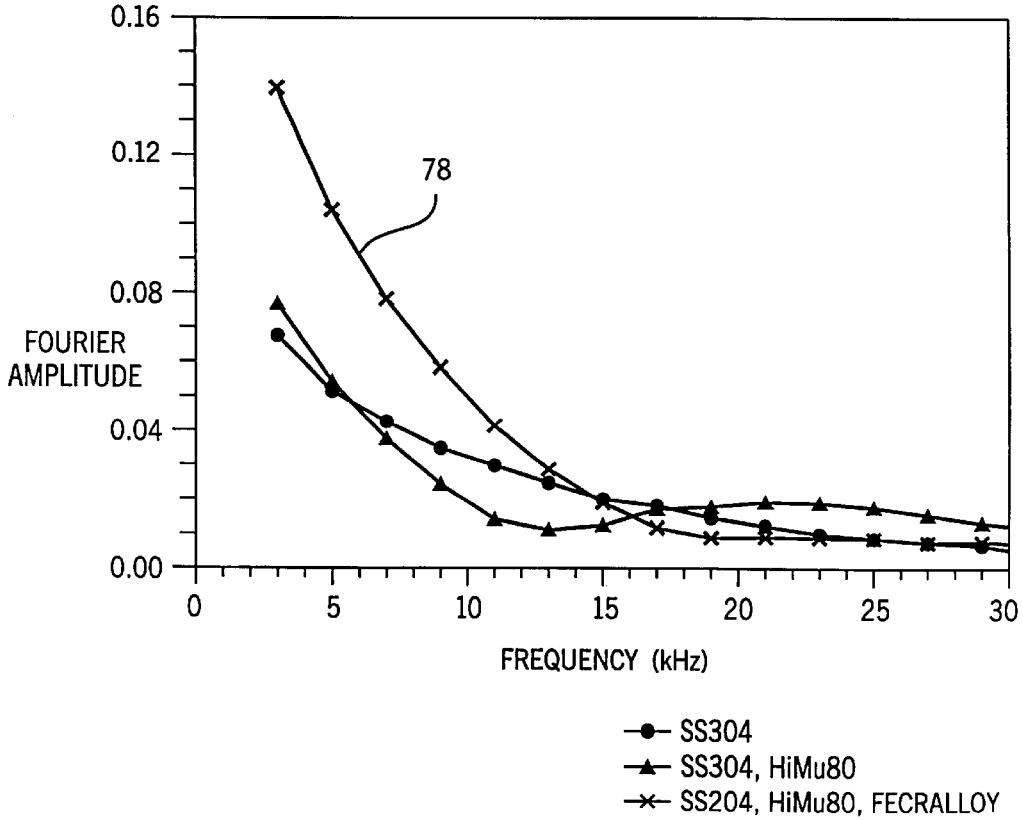
FIG. 14 is a plot of the output of the Fourier transform circuit of FIG. 13 for different combinations of the three filament types of FIG. 10.

In FIG. 14, a combination of the three filament types are shown by a Fourier transform signal 78 plotted using triangular data points. The Fourier transform signal 78 produced by a combination of the Stainless Steel 304 and the Hi-Mu 80 filaments 40 is plotted using rectangular data points. A Fourier transform signal 78 produced by only Stainless Steel 304 filaments is plotted using circular data points.

Measurements of the Fourier transform signals 78 shown in FIG. 14, at nine and nineteen kilohertz will accurately define the mixture.

The above description has been that of a preferred embodiment of the present invention. It will occur to those that practice the art that many modifications may be made without departing from the spirit and scope of the invention. For example, because the filaments respond primarily in one direction, three orthogonal coils could be used for detection and/or excitation of the filaments. The coils would be electrically isolated because of their orientation but could also be sequentially activated or distributed along a conveyor belt or the like so as to further minimize interference. In order to apprise the public of the various embodiments that may fall within the scope of the invention, the following claims are made.

We claim:

1. A substance suitable for remote sensing of multi-bit information comprising:

a non-magnetic matrix;

a first set of magnetizable filaments supported and dispersed by the matrix, the material of the first set of magnetizable filaments having first magnetic properties defining a first functional relationship between magnetic induction (B) and magnetic field (H); and a second set of magnetizable filaments supported and dispersed by the matrix, the material of the second set of magnetizable filaments having second magnetic properties defining a second functional relationship between magnetic induction (B) and magnetic field (H) different from the first magnetic properties; and wherein the first and second sets of filaments overlap within the matrix.

2. The substance of claim 1 wherein the material of the first set of magnetizable filaments has a greater coercivity than the material of the second set of magnetizable filaments.

3. The substance of claim 1 including in addition no less than one additional set of magnetizable filaments supported and dispersed by the matrix, the material of each of the sets of magnetizable filaments having magnetic properties different from the magnetic properties of all other sets of magnetizable filaments.

4. The substance of claim 1 wherein the first and second sets of magnetizable filaments are randomly dispersed in the matrix.

5. The substance of claim 1 wherein the filaments of the first and second filament sets are dispersed in the matrix in predetermined unequal proportion based on their detectability by a remote magnetic sensor system.

6. The substance of claim 1 wherein the materials of the sets of filaments are selected from the group consisting of: Supermalloy, Nickel iron alloys, low carbon steel, Fecralloy and stressed Stainless Steel.

7. The substance of claim 1 wherein the filaments have an aspect ratio of length to thickness of greater than 3.

8. The substance of claim 1 wherein the matrix is selected from the group consisting of: paint; paper, woven textiles, knitted textiles, non-woven textiles, compost wood products, ceramic, and solid polymer.

9. The substance of claim 1 wherein the filaments have a length greater than 1 millimeter.

10. A remote sensor for sensing a target formed of a non-magnetic matrix material supporting a plurality of sets of magnetizable filaments each of the sets of magnetizable filaments having a magnetic property defined as a functional relationship between magnetic induction (B) and magnetic field (H) different from the magnetic properties of all other sets of magnetizable filaments, the remote sensor comprising:

(1) an electric oscillator producing a waveform having a fundamental frequency;

(2) an antenna structure connected to the electric oscillator for transmitting the waveform as an electromagnetic field to envelop the sensing target within a sensing zone;

(3) a receiver connected to the antenna structure for receiving an electromagnetic field as modified by the sensing target; and (4) a detector discriminating between the magnetic properties of the sets of magnetizable filaments to independently detect individual at least two sets of magnetizable filaments, wherein at least a portion of the at least two sets of magnetizable filaments are simultaneously disposed within the sensing zone.

11. The remote sensor of claim 10 wherein the detector includes a differentiator and a phase sensitive threshold detector detecting peaks in the derivative of the received magnetic field as a function of the phase of the waveform of the electric oscillator.

12. The remote sensing system of claim 10 wherein the detector includes a Fourier transformer and a threshold detector for detecting magnitudes of Fourier components at predetermined harmonics of the waveform of the electric oscillator.

13. A remote sensing system comprising:

a sensing target formed of a non-magnetic matrix material supporting a plurality of sets of magnetizable filaments each of the sets of magnetizable filaments having a magnetic property defined as a functional relationship between magnetic induction (B) and magnetic field (H) different from the magnetic properties of all other sets of magnetizable filaments;

a remote sensor including (1) an electric oscillator producing a waveform having a fundamental frequency;

(2) an antenna structure connected to the electric oscillator for transmitting the waveform as an electromagnetic field to simultaneously envelop at least two of the sets of magnetizable filaments within the sensing target;

(3) a receiver connected to the antenna structure for receiving an electromagnetic field as modified by the sensing target; and (4) a detector discriminating between magnetic properties of the sets of magnetizable filaments to independently detect individual sets of magnetizable filaments.

14. The remote sensing system of claim 13 wherein the detector includes a differentiator and a phase sensitive threshold detector detecting peaks in the derivative of the received magnetic field as a function of the phase of the waveform.

15. The remote sensing system of claim 13 wherein the detector includes a Fourier transformer and a threshold detector for detecting magnitudes of Fourier components at predetermined harmonics of the waveform.

16. A method of verifying manufacturing operations in the assembly of multi-component products comprising the steps of:

(a) identifying at least a first and second component of the multi-component product;

(b) attaching to the first component a plurality of magnetizable filaments having a first magnetic property defined as a functional relationship between magnetic induction (B) and magnetic field (H);

(c) attaching to the second component a plurality of magnetizable filaments having a second magnetic property defined as a functional relationship between magnetic induction (B) and magnetic field (H) and different from the first magnetic property;

(d) simultaneously exposing at least a portion of the first and second components of the assembled multi-component product to a magnetic waveform;

(e) detecting a distortion of the waveform caused by magnetic induction in the magnetizable filaments to detect the presence of the first and second components; and (f) providing an output signal indicating proper assembly of the multi-component product.

17. The method of claim 16 wherein the step (f) provide an output signal indicating proper assembly of the multi-component product if both magnetizable filaments of both the first and second components have been detected.

18. The method of claim 16 wherein the step (f) provide an output signal indicating proper assembly of the multi-component product if a predetermined one and only one of the magnetizable filaments of both the first and second components have been detected.

19. The method of claim 16 wherein the volume ratio of filaments to supporting material of either of the first and second component is less than 1%.

20. The substance of claim 16 wherein the volume ratio of filaments to supporting material of either of the first and second component is less than 0.1%.

* * * * *